US005797256A

United States Patent [19]

Baader et al.

[11] Patent Number: 5,797,256

[45] Date of Patent: Aug. 25, 1998

[54] APPARATUS FOR HEATING AN ADVANCING YARN

[75] Inventors: Uwe Baader, Wuppertal; Johannes Bruske, Remscheid, both of Germany

[73] Assignee: Barmag AG, Remscheid, Germany

[21] Appl. No.: 670,541

[22] Filed: Jun. 27, 1996

[30] Foreign Application Priority Data

Jun. 27, 1995 [DE] Germany ..... 195 23 356.5

[51] Int. Cl.[6] ..... D01H 5/00; B65H 57/00; F27B 9/06

[52] U.S. Cl. ..... 57/290; 57/284; 57/352; 219/388

[58] Field of Search ..... 57/290, 284, 352; 219/388; 226/119; 242/157 R

[56] References Cited

U.S. PATENT DOCUMENTS

| | | | |
|---|---|---|---|
| 2,990,670 | 7/1961 | Kingbury | 57/34 |
| 3,559,965 | 2/1971 | Ishida | 263/3 |
| 4,567,721 | 2/1986 | Kuroda et al. | 57/284 |
| 5,138,829 | 8/1992 | Tanae et al. | 57/288 |
| 5,148,666 | 9/1992 | Bauer et al. | 57/290 |
| 5,353,583 | 10/1994 | Tanae et al. | 57/288 |
| 5,404,705 | 4/1995 | Yanagihara et al. | 57/284 X |
| 5,438,820 | 8/1995 | Nakahara et al. | 57/290 |
| 5,628,175 | 5/1997 | Fischer | 57/290 |
| 5,628,176 | 5/1997 | Morhenne et al. | 57/290 |

FOREIGN PATENT DOCUMENTS

| | | |
|---|---|---|
| 2 451 415 | 10/1986 | France . |
| 25 34 598 | 2/1977 | Germany . |
| 43 18 675 | 12/1993 | Germany . |
| 44 23 202 | 1/1995 | Germany . |
| WO 94/29501 | 12/1994 | WIPO . |

*Primary Examiner*—C. D. Crowder
*Assistant Examiner*—Tina R. Taylor
*Attorney, Agent, or Firm*—Bell Seltzer Intellectual Property Law Group of Alston & Bird LLP

[57] ABSTRACT

An apparatus for heating an advancing yarn is disclosed, which comprises an elongate heater body having a U-shaped channel accommodating a plurality of yarn guides. The yarn guides are configured and positioned such that the yarn advancing through the heating apparatus is deflected along a non-linear path of travel which includes several straight line segments which are closely adjacent and parallel to each of the side walls of the channel. The non-linear path effectively increases the yarn length in the heating apparatus, thereby facilitating high speed operation, and without unduly increasing the frictional resistance of the apparatus on the yarn.

13 Claims, 3 Drawing Sheets

APPARATUS FOR HEATING AN ADVANCING YARN

BACKGROUND OF THE INVENTION

The invention relates to an apparatus for heating an advancing yarn, and which is adapted for use in a yarn false twisting machine.

EP 0 412 429 and corresponding U.S. Pat. No. 5,148,666 describe a heating apparatus of the described type, and wherein the yarn is guided by means of a plurality of yarn guides along a heater in the general direction of the advancing yarn. The yarn guides are arranged in a channel of the heater, so that the heating surfaces of the heater facing the channel contribute to the heating of the yarn. The yarn guides extend along a curved line, which is spaced from the heating surfaces. This curved line forms a zigzagged yarn path of travel, which is spaced from the heating surfaces over the entire length of the heating apparatus. While, when related to the length of the heating apparatus, the zigzagged yarn path increases the yarn length which is subjected to heating in the heating apparatus, it also increases the friction of the yarn on the yarn guides. An increase of the friction on the yarn guides is disadvantageous to the yarn tension. To achieve an effective heating, the yarn should remain in a guided state in the heating apparatus as long as possible, and yet be subjected to little friction. However, this requirement is difficult to achieve in the case of increased yarn speeds.

It is therefore the object of the present invention to provide a heating apparatus for heating an advancing yarn, in which the friction of the yarn on the yarn guides is reduced while maintaining a high yarn speed and a substantially unchanged heat transfer.

SUMMARY OF THE INVENTION

The above other objects and advantages of the present invention are achieved by the provision of an apparatus for heating an advancing yarn which is designed and constructed as an elongate heater body with heating surfaces in the form of a channel having opposite side walls, and in which several yarn guides are arranged, one following the other, in the direction of the advancing yarn. The yarn guides are positioned along a line so as to provide a non-linear path of travel of the advancing yarn, and in accordance with the invention, at least some of the yarn guides are arranged in groups of at least two adjacent yarn guides, and some of the groups support the yarn closer to one of the side walls of the channel while others of the groups support the yarn closer to the other side wall of the channel. Preferably, the path of yarn travel includes several straight line segments along and parallel to each of the side walls of the channels, which results in a lesser looping of the yarn on the yarn guides and, thus, a reduced friction to be realized.

The channel is preferably of generally rectangular cross section so as to define parallel opposite side walls and a bottom wall. Also, the yarn guides are configured to maintain the advancing yarn spaced from the side walls and the bottom wall along the length of the channel.

In a preferred embodiment, the yarn guides are arranged such that the path of travel is subjected to a change in direction respectively before or after at least two yarn guides, one directly following the other.

In a preferred embodiment, two yarn guides each next to one another in the direction of the advancing yarn extend along a straight line which is substantially parallel to the side walls of the channel, and they are arranged such that the yarn, when passing over the yarn guides, assumes a distance from the side walls, which alternately varies in pairs. Each line segment of the advancing yarn that is formed by the two side-by-side yarn guides, faces a respective one of the side walls in an off-center relationship, when related to the center of the channel in the heating apparatus. In this manner, the yarn alternately contacting two side-by-side yarn guides successively faces one side wall of the channel, so as to merge, after leaving this segment, into a line segment of yarn advance, which extends likewise substantially parallel to the opposite side wall of the channel in the heating apparatus. Arranged in the channel of the heating apparatus are several of these pairs of yarn guides. Such a double arrangement of two yarn guides which alternate with one another on each of the heating surfaces, means that the direction gradient changes its sign after every second yarn guide.

In one preferred embodiment, the yarn guides are constructed as slide-in plates or disks, which are mounted in aligned yarn guide slots which are formed in the opposite side walls of the channel of the heating apparatus.

In a further preferred embodiment, the yarn guides are constructed as rod-shaped elements, which are arranged in contact with the side walls, and which are contacted by the yarn. The rod-shaped elements are arranged such that the yarn advances always along the side of the yarn guides facing away from the side walls, the yarn path along the side-by-side yarn guides being however likewise off-center. Preferably, the rod-shaped elements have a circular cross section, although other rounded cross sections are possible, such as, for example, oval cross sections, slightly flattened cross sections, and the like.

In a yet further preferred embodiment, the yarn guides are constructed as corrugated elements which are attached to the side walls of the channel of the heating apparatus. Preferably, the corrugated elements have a substantially semicylindrical cross section, or a cross section in the shape of a sine wave.

It is preferred to space the yarn guides equally from one another, so that the curve segments of the yarn path, which are formed each by the two side-by-side yarn guides and extend substantially parallel to the side walls, have each the same length, so as to ensure an as uniform as possible heating of the yarn during its passage through the heating apparatus.

In still another preferred embodiment, three yarn guides each are arranged off-centered with respect to the channel, so that the direction gradient of the curve formed by the advancing yarn curve changes its sign only after every third of the three yarn guides, the curve of the advancing yarn assuming preferably a substantially sinusoidal course.

BRIEF DESCRIPTION OF THE DRAWINGS

Further advantages and possible applications of the present invention are now described in more detail with reference to the attached drawings, in which.

DETAILED DESCRIPTION OF THE PREFERRED EMBODIMENTS

Figure 1:
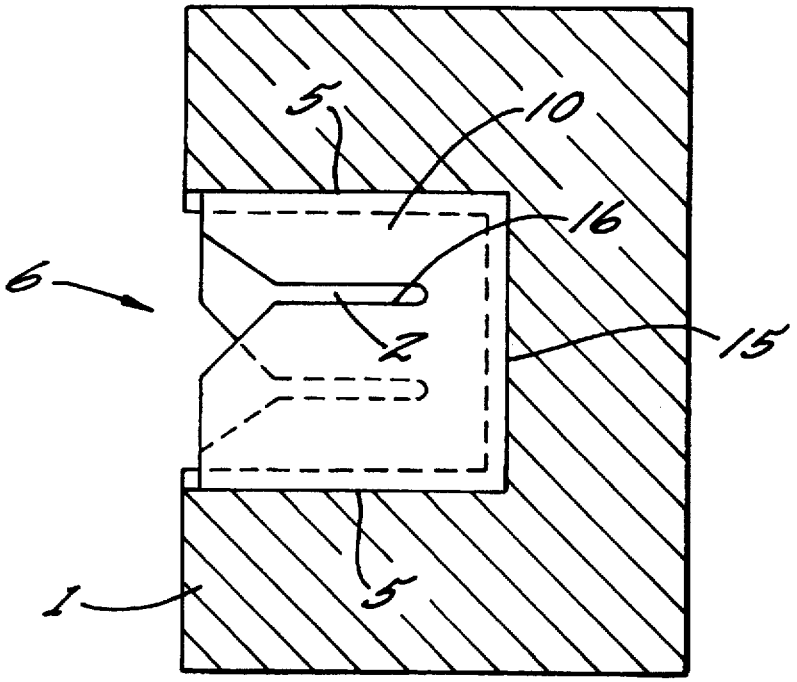
FIG. 1 is a cross sectional view of a heater in accordance with the invention.

FIG. 1 is a cross sectional view of a heating apparatus 1 which embodies the present invention and which includes a U-shaped body having a U-shaped channel 6 therein. The channel 6 is of generally rectangular cross-section so as to define parallel opposite side walls 5 and a bottom wall 15. The body is constructed such that the heating elements (not shown) arranged in the body deliver their heating energy above the bottom wall 15 as well as from the side walls 5. Arranged in the groove are yarn guides 2 that are provided in generally flat plates 10. These yarn guides 2 are machined in the form of yarn guide slots in the plates 10, the slots extending substantially parallel to the side walls 5 and in a direction toward the groove bottom wall 15. Depending on the yarn speed and existing heating energy, as well as the yarn material, the yarn guide slots may be arranged closer to the heating surfaces or be further removed therefrom. However, in accordance with the invention, these yarn guide slots are always arranged in the region between the central plane (which is defined centrally between the two side walls) and one of the side walls 5. Since a yarn, not shown in FIG. 1, which advances in the yarn guide slots, undergoes a deflection on each yarn guide, the deflection surfaces 16 are made round across the thickness of the plates 10, so as to exert the least possible influence on the yarn tension, when the yarn enters into the yarn guide slot. The flat plates 10 which are substantially equally spaced in the direction of the advancing yarn, have on their side facing away from heating apparatus 1 a funnel-shaped inlet, so as to facilitate the entry of the yarn into the yarn guide slot.

Figure 2:
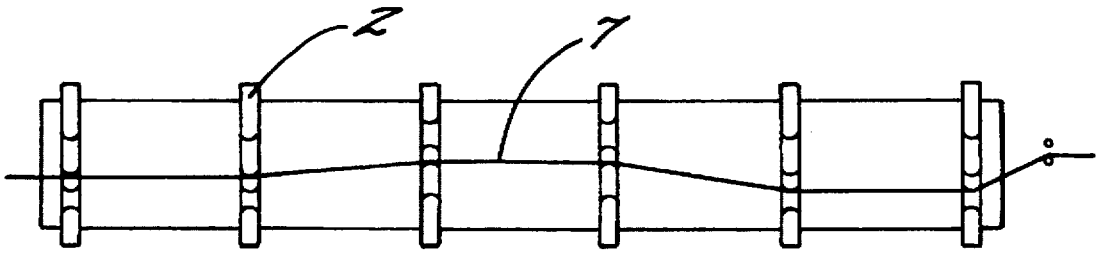
FIG. 2 is a top view of the channel cross section of the heating apparatus.

FIG. 2 is a top view of the channel of the heating apparatus. For reasons of clarity, covers which normally enclose the heating apparatus are not shown. The substantially evenly spaced yarn guides 2 are shown each with their yarn guide slots, through which a yarn 7 advances. The first two yarn guides, as shown on the left in FIG. 2, are provided with yarn guide slots which have a same distance from each of the side walls 5, so that between these two yarn guides, a substantially parallel advance of the yarn results, i.e., parallel to the direction of the side walls 5. The yarn guide slots are rounded in accordance with the deflection of the yarn, as it enters into the first yarn guide and as it leaves the second yarn guide. The yarn advances through the slots of the next two yarn guides, the slots of which are arranged such that the path of yarn 7, which is substantially parallel to side walls 5, extends closer to the side wall 5 that is opposite to the side wall which is closer to the yarn 7 between the first and the second yarn guide.

In comparison with a zigzagged line of the yarn path or yarn curve, as is known from the prior art, the yarn guidance of the present invention has the advantage that the yarn loops less about the yarn guides and, thus, its friction is reduced. This advantage is achieved in that the yarn is deflected, for example on every second or third yarn guide by the amount of overlap of the yarn guides with respect to the central plane of the channel.

As a result of the fact that, when arranged in pairs, always two adjacent yarn guides extend along a line parallel to the channel, the zigzagged course of the yarn, as known from the prior art, is interrupted respectively by straight partial line segments. The looping angle on the yarn guide is only half as much, when compared with the looping angle of the prior art arrangement (one third in an arrangement of three, etc.). The overlap of the yarn guides beyond the central plane of the channel is dependent on process parameters, or yarn materials, or the heat output installed.

In a double arrangement, the contact zone between yarn and yarn guide, which is reduced by about 50% results in a positive influence on the advancing yarn, in particular with small overlaps and narrow tolerances. The length of the heating apparatus, i.e., the length of the yarn, which is exposed to the heating apparatus for purposes of heating, is determined in accordance with the process parameters, in particular in accordance with the type of yarn. Yarn thickness, yarn speed, temperature of the heater, dimensioning of the heating apparatus, etc. are relevant parameters to this end. Assuming, for example, that the overall length is to be one meter, a length of 500 mm will result for each individual heater, of which several may be arranged, one after the other, in the entire installation.

It has been found useful to arrange four yarn guides in the first heater or first heating apparatus, when viewed in the direction of the yarn advance through the equipment, and five yarn guides in the second heating apparatus. With such a configuration, the spacing of the individual yarn guides is in a range of about 125 mm, this value being naturally dependent on process and material parameters.

Figure 3:
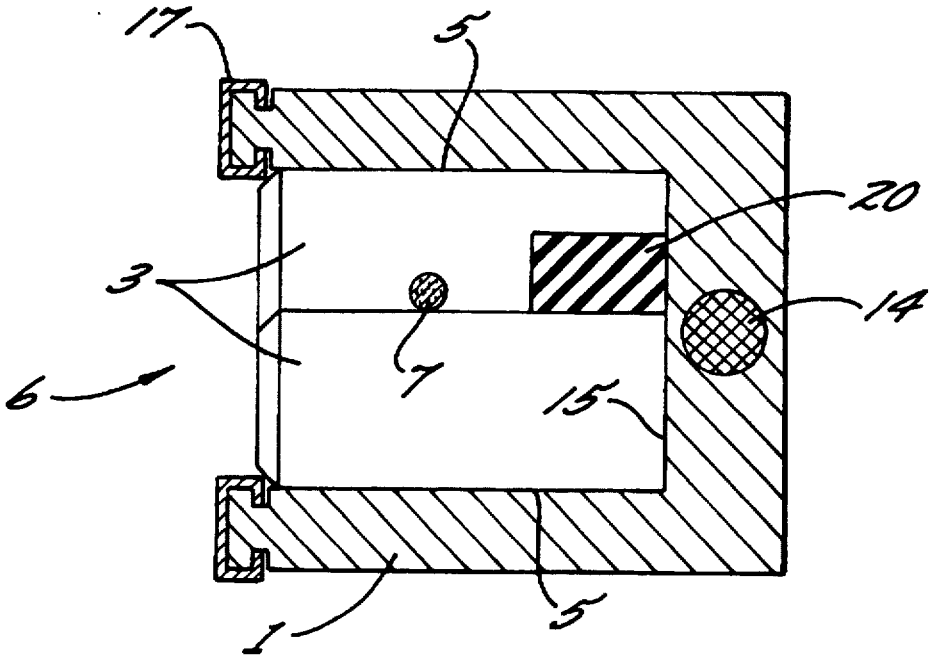
FIG. 3 is a front view of a second embodiment of a heating apparatus in accordance with the present invention.

FIG. 3 is a sectional front view of a second embodiment of a heating apparatus 1 which embodies the present invention. The heating apparatus 1 is constructed as a U-shaped rail and defines in its interior a channel 6 with side walls 5 and bottom wall 15 which serve as heating surfaces. The illustrated heating apparatus 1 accommodates a resistance heater 14, which provides a supply of heat energy into the interior of the channel. Provided in axial channel 6 is a structural unit, which is secured preferably by clamps. This structural unit consists of a strip-shaped carrier 20 and yarn guides 3 laterally arranged thereon. The yarn guides are arranged offset from one another on both sides, namely in equally-spaced pairs. The carrier 20 is deformed by the clamping of the structural unit, so that it is in contact respectively with two opposite, successive pairs of yarn guides. In this manner, the structural unit is fitted in the channel by the action of elastic clamping forces. The yarn guides 3 are held in channel 6 by caps 17. These caps 17 are C-shaped and cover the upper edge of each side wall of the channel 6, while engaging themselves into small axial grooves, which are provided on both sides of the upper edges in the side walls 5 of the channel.

Figure 4:
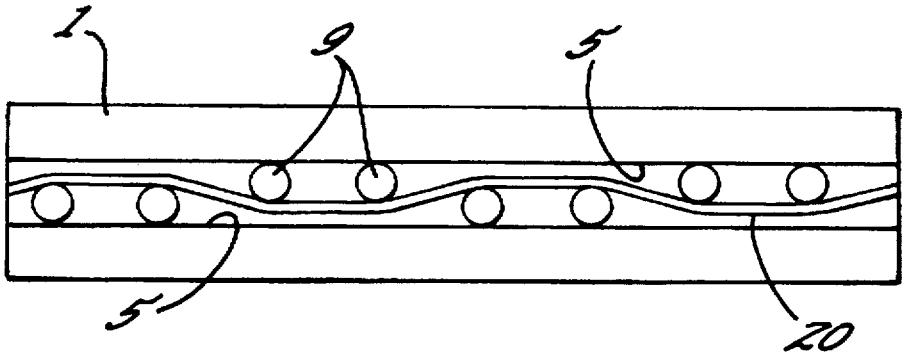
FIG. 4 is a top view of the channel in the heating apparatus of FIG. 3, with a carrier and yarn guides.

FIG. 4 is a top view of an embodiment wherein the guides are in the form of rod-like elements 9 of circular cross section. The elements 9 are interconnected by an axial carrier 20 so as to be in contact with respective ones of the side walls 5. When inserting the assembly of the carrier 20 and the yarn guides 9 into the channel, the carrier 20 is forced to assume a linear configuration corresponding to that shown in FIG. 4. This means that the carrier contacts respectively two adjacent yarn guides, which are arranged in the direction of the advancing yarn, one after the other, alternating in pairs on opposite side walls of the channel. The individual yarn guides rest against the side walls, i.e., the heating surfaces of the channel. With respect to the selection of the material, it is important that the strip, which forms carrier 20, be elastic and remain elastic even during the expected heating to more than 400° C.

Figure 5:
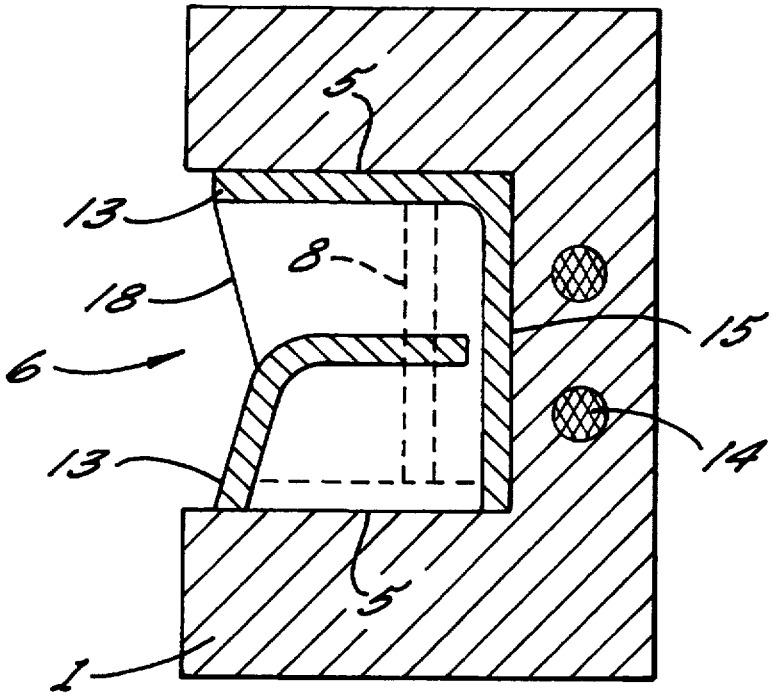
FIG. 5 is a cross sectional view of the heating apparatus in accordance with a further embodiment of the invention.

Shown in FIG. 5 is cross sectional view of a further embodiment of a heating apparatus 1 in accordance with the invention. The heating apparatus of this embodiment is constructed again as an elongate, U-shaped body, which accommodates in its interior resistance heaters 14 that are inserted in corresponding bores of the heating apparatus 1, and serve to heat the channel 6 formed in the U-shaped body. In channel 6, two metal strips 13 are inserted, which rest against the opposite side walls 5, which form the heating surfaces of the axial channel. Protuberances in the shape of corrugations serve as yarn guides and face again, in pairs, the opposite side walls. The two metal strips 13 are interconnected, via cross members 8 in the region of the bottom wall 15, so as to secure the metal strips 13 in their position relative to one another, and also to prevent the yarn from contacting the bottom wall 15 of channel. For this reason, the cross members 8 are arranged preferably at a distance from the bottom wall 15. The corrugations are beveled on their upper edges 18 so as to form a V-shaped notch, which likewise facilitates the insertion of the yarn.

Figure 6:
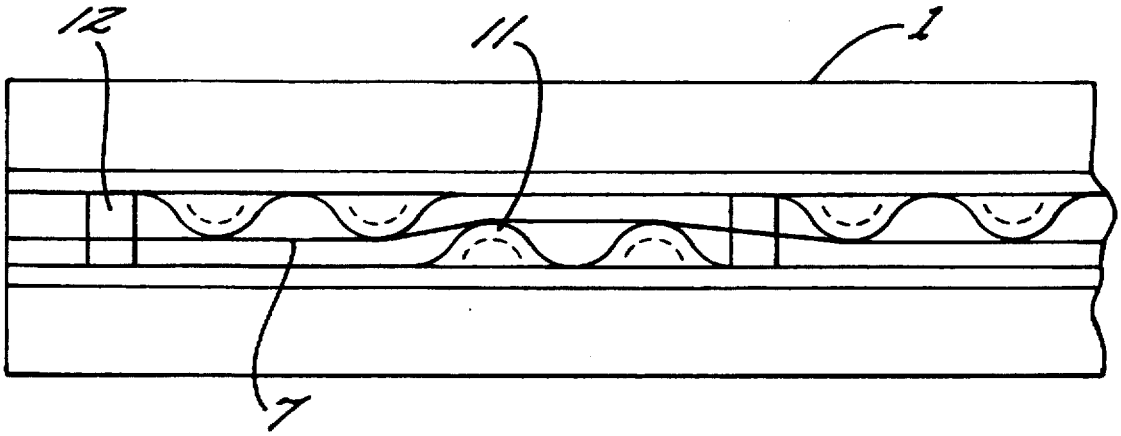
FIG. 6 is a top view of the channel cross section of a heating apparatus with yarn guide elements arranged therein in the form of corrugations.

Shown in FIG. 6 is a top view of a further embodiment of the invention. Protuberances in the shape of corrugations are used as yarn guides 11, which are arranged, in pairs, one after the other, each on opposite sides of the channel 6, so that between two corrugated protuberances, the yarn extends substantially parallel to the side walls 5, the protuberances having a height so as to extend beyond the central plane of the channel 6. In the region of the bottom wall 15, cross members 12 are provided for mounting the yarn guides 11 on each of the side walls 5.

In the drawings and the specification, there has been set forth preferred embodiments of the invention and, although specific terms are employed, the terms are used in a generic and descriptive sense only and not for the purpose of limitation, the scope of the invention being set forth in the following claims.

That which is claimed is:

1. An apparatus for heating an advancing yarn comprising an elongate heater body having a channel therein which extends in an axial direction along the length of the heater body and which defines opposite side walls and a bottom wall, means for heating the heater body, and a plurality of yarn guides disposed in the channel so as to guide the advancing yarn axially along the channel in a non-linear path of travel, wherein at least some of the yarn guides are arranged in groups of at least two next adjacent yarn guides, with some of the groups being configured to support the advancing yarn closer to one of the side walls than the other side wall and with others of the groups being configured to support the advancing yarn closer to the other side wall than the one side wall, and wherein said yarn guides are configured to maintain the advancing yarn spaced from the side walls and the bottom wall along the length of the channel.

2. The yarn heating apparatus as defined claim 1 wherein the channel has a generally rectangular cross section so as to define the opposite side walls and the bottom wall, and a central plane which is parallel to and equally spaced between said opposite side walls.

3. The yarn heating apparatus as defined in claim 2 wherein at least two adjacent yarn guides of each of said groups of yarn guides are configured so that the yarn advances therebetween along a straight line segment which extends in a direction parallel to the central plane.

4. The yarn heating apparatus as defined in claim 2 wherein said yarn guides are substantially equally spaced apart in the axial direction.

5. The yarn heating apparatus as defined in claim 2 wherein each of said yarn guides comprises a substantially flat plate, with said plates each including a yarn receiving slot, with the slots of at least some of the plates being laterally offset from said central plane.

6. The yarn heating apparatus as defined in claim 5 wherein said slots of said yarn guides each include a generally V-shaped inlet so as to facilitate the entry of the yarn into the slot.

7. The yarn heating apparatus as defined in claim 2 wherein each of said yarn guides comprises a rod-like element which is positioned so as to be perpendicular to said bottom wall and in contact with one of said side walls of said channel.

8. The yarn heating apparatus as defined in claim 7 wherein each of said rod-like elements has a circular cross section.

9. The yarn heating apparatus as defined in claim 7 wherein said rod-like elements are interconnected with a carrier which extends in the axial direction and which is positioned in said channel.

10. An apparatus for heating an advancing yarn comprising an elongate heater body having a channel therein which extends in an axial direction along the length of the heater body and which defines opposite side walls, means for heating the heater body, and a plurality of yarn guides disposed in the channel so as to guide the advancing yarn axially along the channel in a non-linear path of travel, wherein the yarn guides are arranged in groups of at least two next adjacent yarn guides, with the groups alternating along the length of the heater body such that alternate groups support the advancing yarn closer to one of the side walls of the channel than the other side wall and intervening groups support the advancing yarn closer to the other side wall than the one side wall.

11. The yarn heating apparatus as defined claim 10 wherein the channel has a generally rectangular cross section so as to define the opposite side walls, a bottom wall, and a central plane which is parallel to and equally spaced between said opposite side walls, and wherein said yarn guides are configured to maintain the advancing yarn spaced from the side walls and the bottom wall along the length of the channel.

12. The yarn heating apparatus as defined in claim 11 wherein at least two adjacent yarn guides of each of said groups of yarn guides are configured so that the yarn advances therebetween along a straight line segment which extends in a direction parallel to the central plane.

13. The yarn heating apparatus as defined in claim 12 wherein said yarn guides are substantially equally spaced apart in the axial direction.

* * * * *